US006022328A

United States Patent [19]

Hailey

[11] Patent Number: 6,022,328

[45] Date of Patent: Feb. 8, 2000

[54] ELECTRIC MASSAGER

[76] Inventor: Scott M. Hailey, 1117 Ring St., Keizer, Oreg. 97303

[21] Appl. No.: 09/116,893

[22] Filed: Jul. 17, 1998

[51] Int. Cl.[7] ..... A61H 1/00

[52] U.S. Cl. ..... 601/69; 601/46; 601/67; 601/71

[58] Field of Search ..... 601/46, 47, 48, 601/67, 68, 69, 70, 71, 72, 73, 74, 79, 80, 81, 15, 18, 84; D24/200, 215, 206; 602/19, 20

[56] References Cited

U.S. PATENT DOCUMENTS

| | | | |
|---|---|---|---|
| D. 371,443 | 7/1996 | Lie . | |
| 1,497,840 | 6/1924 | Clement | 601/46 |
| 2,687,718 | 8/1954 | Britton et al. . | |
| 2,944,543 | 7/1960 | Newcombe . | |
| 3,053,250 | 9/1962 | Stubbs . | |
| 3,799,154 | 3/1974 | Knop . | |
| 3,896,795 | 7/1975 | Solhkhah | 601/46 |
| 4,343,303 | 8/1982 | Williams . | |
| 4,878,489 | 11/1989 | Kamayachi | 601/72 |
| 4,979,502 | 12/1990 | Hunt . | |
| 5,099,829 | 3/1992 | Wu | 601/46 |
| 5,334,131 | 8/1994 | Omandam et al. . | |
| 5,611,771 | 3/1997 | Taylor | 601/48 |
| 5,913,834 | 6/1999 | Francais | 600/591 |

FOREIGN PATENT DOCUMENTS

| | | | |
|---|---|---|---|
| 466489 | 5/1937 | United Kingdom | 601/47 |

*Primary Examiner*—Richard J. Apley
*Assistant Examiner*—Justine R. Yu
*Attorney, Agent, or Firm*—Richard C. Litman

[57] ABSTRACT

An electric multi-positional massage apparatus adapted to accommodate selected regions of the human anatomy. The massage apparatus employs conventional contractor's wire as the basic foundation for construction. Plural electric motors, having offset weights, are utilized to induce opposed distorted-harmonic vibrations in the apparatus. The apparatus is designed with flexible arm and leg portions which have hook and loop fasteners attached thereto. Incorporation of electric motor control switches on the flexible arm and leg portions allow for hands free operation during the massage process. An electric heating tape is provided to, optionally, supply heat to the apparatus.

15 Claims, 6 Drawing Sheets

ELECTRIC MASSAGER

BACKGROUND OF THE INVENTION

1. Field of the Invention

The present invention generally relates to heated body massagers. More specifically, the invention is a portable, strap-on, heated, multi-positional body massager with plural flexible arm and leg portions. The arm and leg portions are provided with electric motors having offset weights. The motors are designed to generate opposed distorted-harmonic frequency vibrations in the arm and leg portions. Hand operated switches are utilized to control heat, which is applied to the arm portions, and to control electric power to the motors.

2. Description of the Related Art

U.S. Pat. No. 3,053,250 (Stubbs), U.S. Pat. No. 4,343,303 (Williams), U.S. Pat. No. 4,979,502 (Hunt), and U.S. Pat. No. 5,334,131 (Omandam et al.) exemplify types of portable strap on body massagers which are known in the art. It is noted, however, that none of the cited patents contemplate the application of plural motors to generate opposed distorted-harmonic frequency vibrations.

U.S. Pat. No. Des. 371,443 (Lie), U.S. Pat. No. 2,687,718 (Britton et al.), and U.S. Pat. No. 2,944,543 (Newcombe) describe body massagers of the hand held type. Again it is noted that the instant patents are silent as to the concept of adapting plural motors to generate opposed distorted-harmonic frequency vibrations.

U.S. Pat. No. 3,799,154 (Knop) shows a vibrator adapted to be inserted under a mattress or seat cushion.

None of the above inventions and patents, taken either singularly or in combination, is seen to disclose an electric portable strap on massage device having flexible arm and leg members and plural motors as described and claimed in the instant invention.

SUMMARY OF THE INVENTION

The massager of the instant invention is a "no hands", multi-positional, portable, heated, electrically operated device with flexible arm and leg portions adapted to accommodate selected regions of the human body. Plural motors, having offset weights, are incorporated in the device and are designed to generate opposed distorted-harmonic frequency vibrations in the flexible arm and leg portions so as to massage various muscle groups in the human body. The massager is adaptable for either AC or DC operation.

Accordingly, it is a principal object of the invention to provide an improved portable multi-positional massager.

It is another object of the invention to provide an improved portable multi-positional massager incorporating plural motors, which motors are designed to generate opposed distorted-harmonic frequency vibrations.

It is a further object of the invention to provide an improved, portable, multi-positional massager having a heater.

Still another object of the invention is to provide an improved multi-positional massager which is easy to use.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 3:
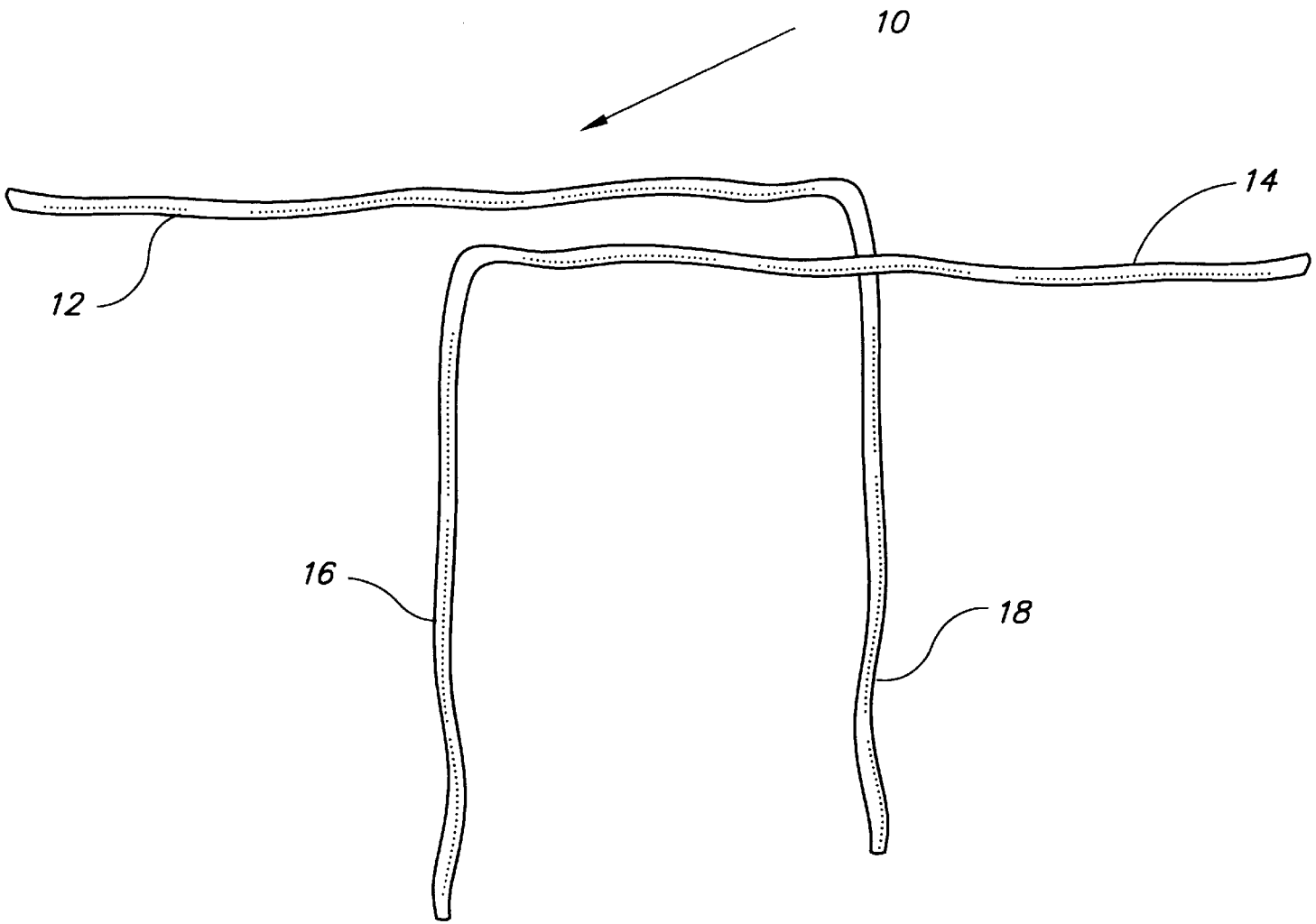
FIG. 3 is a plan view of contractor's wire which forms the basic construction element for the massager of the present invention.

The massager of the instant invention is a "no hands", multi-positional, portable, heated, electrically operated device with flexible arm and leg portions 12,14 adapted to accommodate selected regions of the human body. Turning first to FIG. 3, the initial arrangement for fabricating the massager of the instant invention is shown, wherein two lengths 10 of ten gauge (four wire) contractor's electrical copper wire are bent at right angles as shown to form respective left and right arm portions 12 and 14. Respective left and right leg portions are indicated at 16 and 18.

Figure 4:
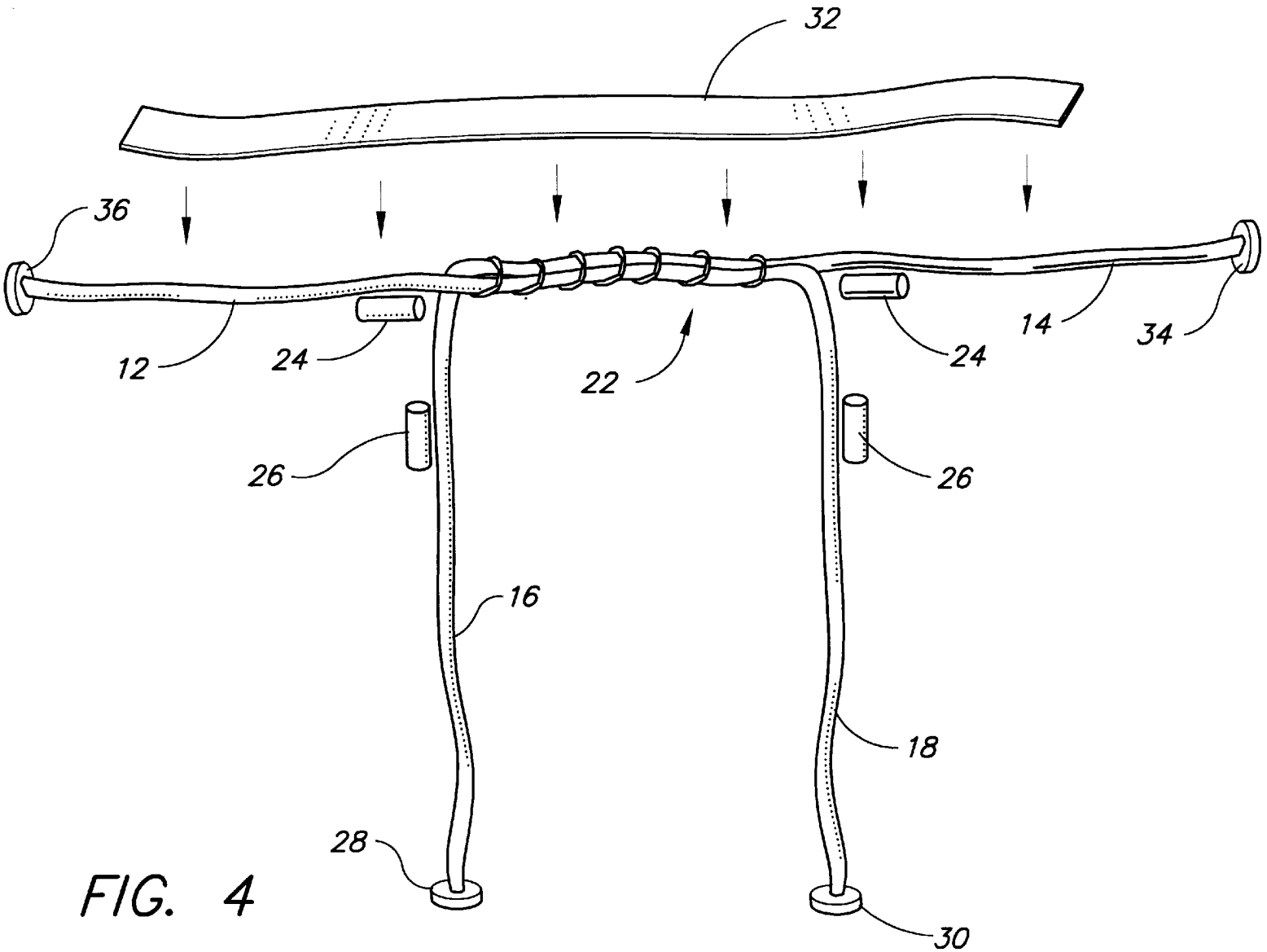
FIG. 4 is an exploded view which shows the assembled contractor's wire with the motors and heating tape.

FIG. 4 shows the initial assembly after the contractor's wire 10 has been bound together to form a section 22 where respective arm and leg portions 12, 16 and 14, 18 intersect. Motors 24, 26 are securely fastened to each arm and leg portion. Arm motors 24 are attached at a position which is as close as possible to the points of intersection and still allows for proper motor function. Leg motors 26 are positioned four to six inches from the point of intersection of the respective arm and leg portions. Motors 24, 26 are sealed in casings and each is provided with offset weights. The weights are not only off-center, but are also offset from the vertical and horizontal axis by about ten degrees. Such motors are well known in the art and, per se, form no part of the inventive concept. Adjacent motors (arm, leg) are wired to have opposite polarity so as to create opposed distorted-harmonic frequency vibrations in the arm and leg portions. Arm motors 24 are wired to be operated by a variable control switch 28 located at the end of left leg member 16. Leg motors 26 are wired to be operated by a variable control switch 30 located at the end of right leg portion 18. An electric heat tape 32 extends the entire length of arm portion 12, section 22, and arm portion 14 for optionally applying heat during the massaging process. Electric heat tape 32 is wired to be operated by a switch 34 located at the end of right arm portion 14. A jack 36 is located at the end of left arm portion 12 which jack is adapted to be connected to an AC or DC source for supplying electric power for motors 24, 26 and electric heat tape 32.

Figure 5:
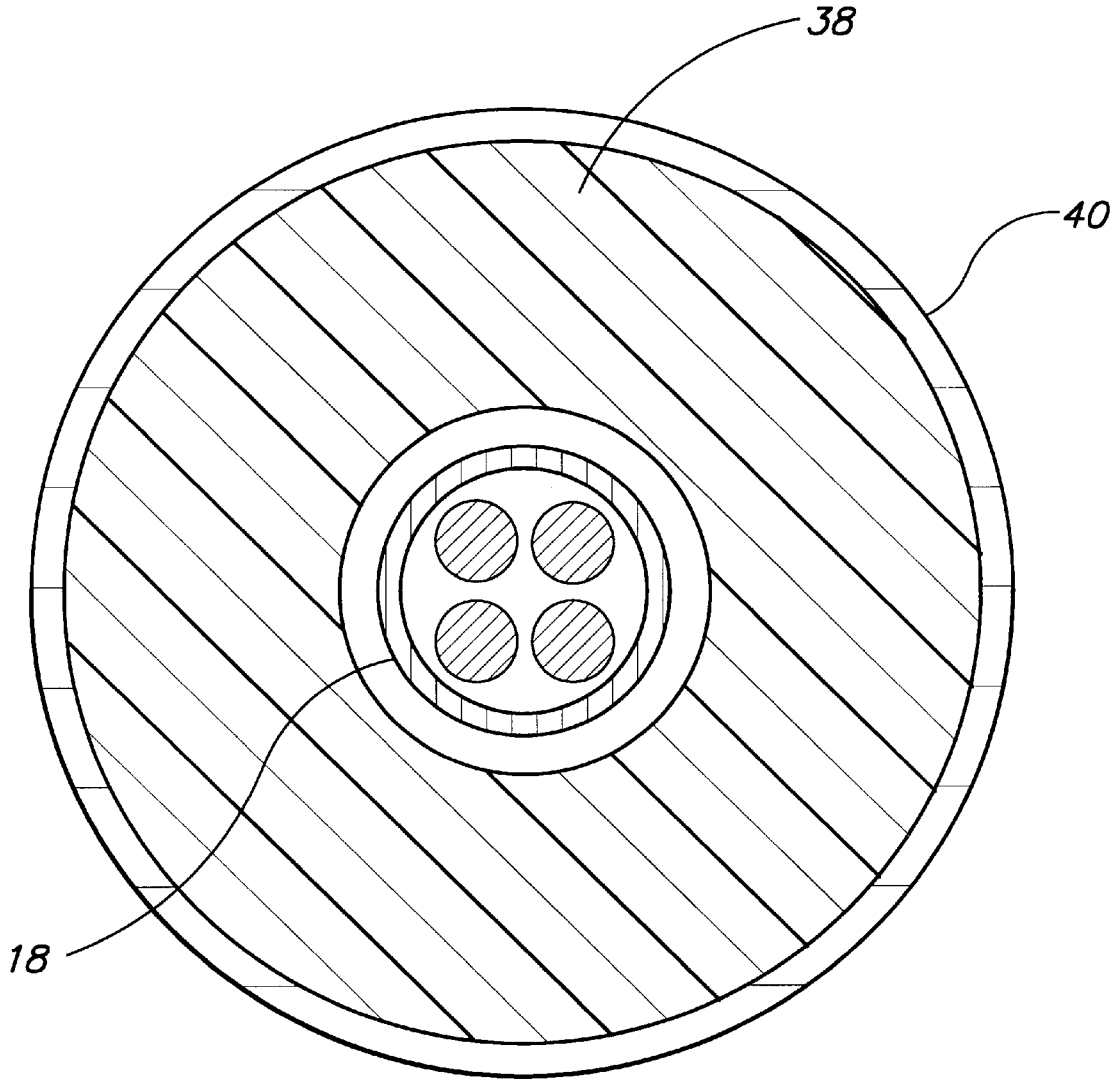
FIG. 5 is a typical cross section of an arm or leg member according to the present invention.

FIG. 5 shows a typical cross section of the assembled apparatus of FIG. 4 after the apparatus has been enclosed in a shell of one half inch ID pipe insulation 38 and further encased in a plastic or rubber casing 40. Casing 40 may be covered with soft cloth material if desired.

Figure 1:
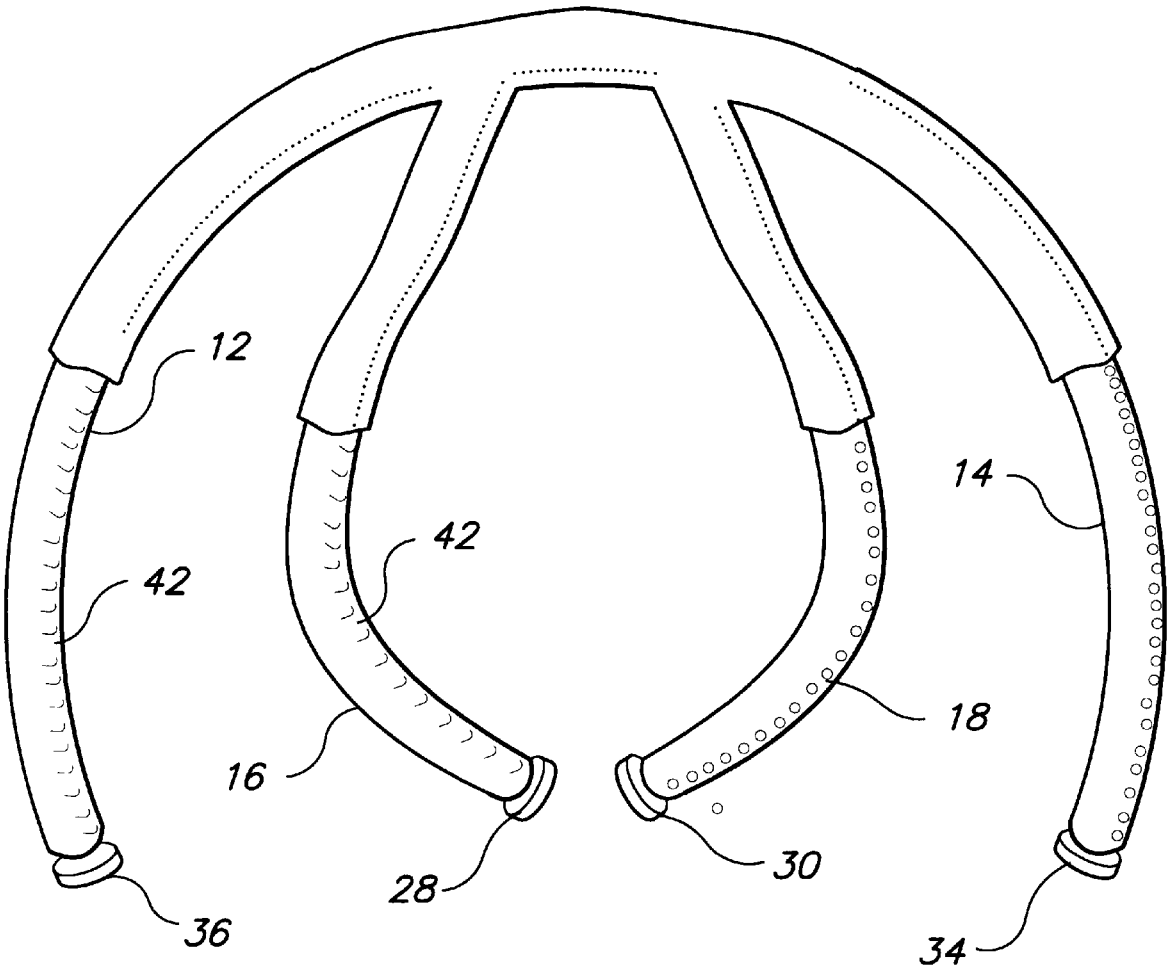
FIG. 1 is a perspective view of an electric massager according to the present invention.

FIG. 1 is a perspective of the massager as finally assembled. Hook and loop fastener strips 42 are disposed on the arm and leg portions so that the apparatus may be fastened in place when employed by a user.

Figure 6:
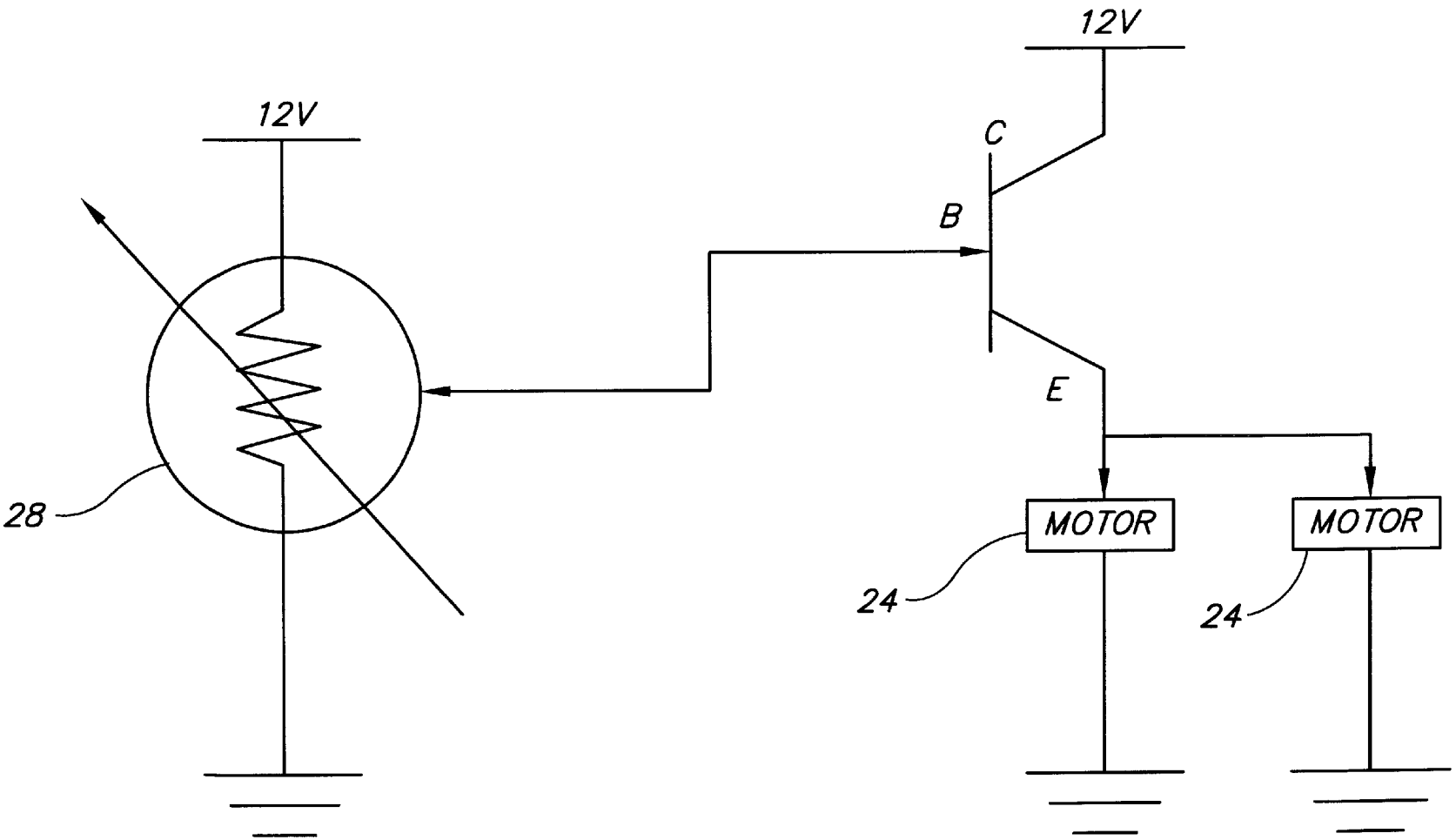
FIG. 6 is a schematic of the electrical circuit of the instant invention.

The schematic of FIG. 6 illustrates a wiring circuit for switch 28. It is to be understood that switch 30 will be provided with an identical circuit. The circuit is designed to include a power amp transistor at B. Power amp transistor B functions to utilize the entire massage apparatus as a heat sink thereby providing heat to the apparatus and requiring minimum use of electric heat tape 32 during the massaging process.

Figure 2A:
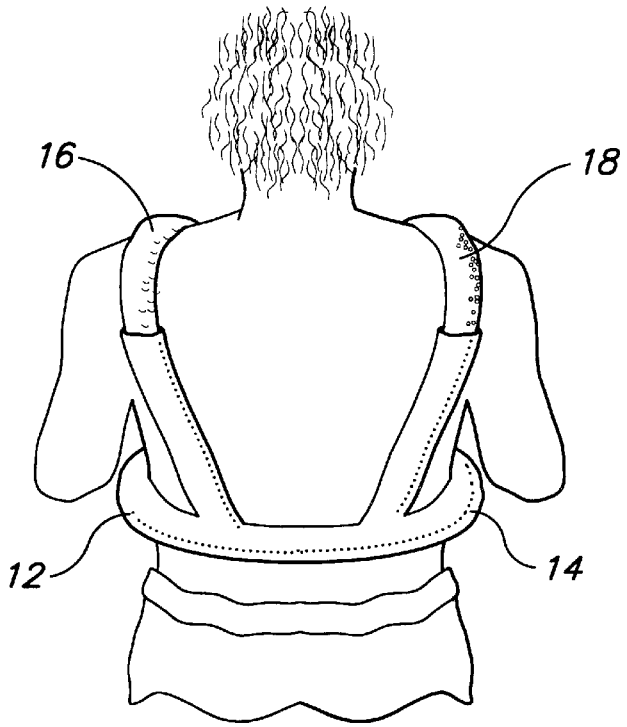
FIGS. 2A. and 2B are environmental perspective views of the electric massager according to the present invention.
Figure 2B:
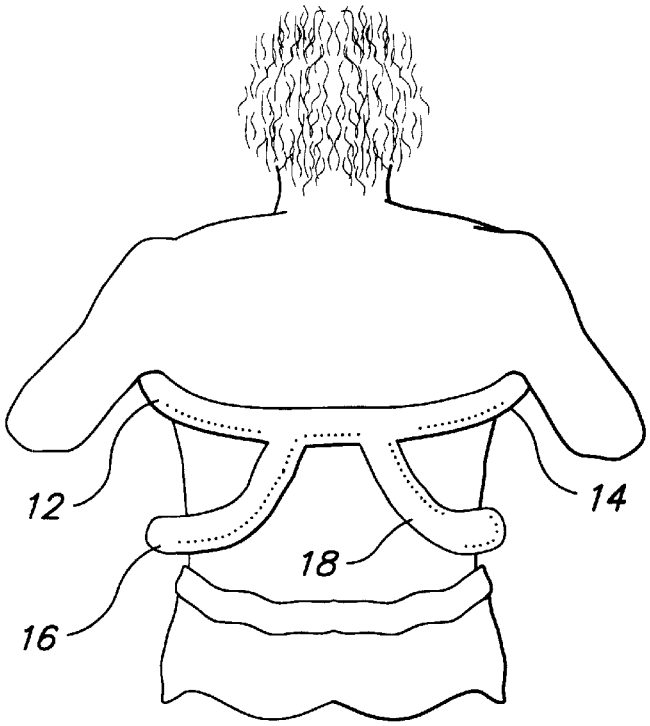

In use, the massager apparatus of the instant invention is adapted to accommodate and provide massage for all of the major muscle groups in the body. FIGS. 2A and 2B are illustrative of two of many possible arrangements that may be employed when using the massager apparatus. For example, as shown in FIG. 2A, the arm and leg portions are pulled to the front of the users body and securely fastened to each other by utilizing the hook and loop fastener strips 42. A battery or AC adapter (neither of which is shown) is attached to the jack 36. Switches 28 and 30 may then be adjusted to provide opposed distorted-harmonic frequency vibrations to the apparatus thus creating a deep, satisfying massage effect.

It is to be understood that the present invention is not limited to the embodiment described above, but encompasses any and all embodiments within the scope of the following claims.

I claim:

1. An assembled apparatus for providing variable vibrations to selected regions of the human anatomy comprising:

elongated flexible and resilient wire members assembled to form respective right and left arm portions, said wire members also assembled to form horizontally spaced right and left leg portions, said right and left leg portions extending perpendicularly from said right and left arm portions;

means for inducing variable vibrations in said apparatus, said means attached to each said right and left arm portions and each said right and left leg portions; and heat providing means, said heat providing means attached to said right and left arm portions.

2. The apparatus as defined in claim 1 wherein said means for inducing variable vibrations comprises four electric motors each having offset weights, each arm portion and each leg portion having a motor attached thereto.

3. The apparatus as defined in claim 2 wherein said motors attached to said left arm portion and to said left leg portion are wired to have opposite polarity whereby opposed distorted-harmonic vibrations are induced.

4. The apparatus as defined in claim 3 wherein said motors attached to said right arm portion and to said right leg portion are wired to have opposite polarity, whereby opposed distorted-harmonic vibrations are induced.

5. The apparatus as defined in claim 4 wherein first and second variable control switches are provided to control electric energy supplied to said electric motors.

6. The apparatus as defined in claim 5 wherein said first variable control switch controls electric energy supplied to said electric motors attached to said arm portions.

7. The apparatus as defined in claim 6 wherein said second variable control switch controls electric energy supplied to said electric motors attached to said leg portions.

8. The apparatus as defined in claim 7 wherein said first variable control switch is positioned at an end of said left leg portion and said second variable control switch is positioned at an end of said right leg portion.

9. The apparatus as defined in claim 8 wherein said heat providing means comprises an electric heating tape.

10. The apparatus as defined in claim 9 wherein a switch is positioned at an end of said right arm portion for controlling a supply of electric energy to said heating tape.

11. The apparatus as defined in claim 10 wherein a jack is positioned at an end of said left arm portion, whereby said apparatus may be connected to a source of electric energy.

12. The invention as defined in claim 11 wherein said apparatus is enclosed in pipe insulation.

13. The invention as defined in claim 12 wherein said pipe insulation is enclosed in a rubber casing.

14. The invention as defined in claim 13 wherein said rubber casing has hook and loop fasteners disposed thereon.

15. An assembled apparatus for providing variable vibrations to selected regions of the human anatomy comprising:

elongated flexible and resilient wire members assembled to form respective right and left arm portions, said wire members also assembled to form horizontally spaced right and left leg portions, said right and left leg portions extending perpendicularly from said right and left arm portions; and means for inducing variable vibrations in said apparatus, said means attached to each said right and left arm portions and each said right and left leg portions.

* * * * *